US009790059B2

(12) United States Patent
Grant et al.

(10) Patent No.: US 9,790,059 B2
(45) Date of Patent: Oct. 17, 2017

(54) GRIPPING DEVICE FOR MACHINE

(71) Applicant: Caterpillar Work Tools B.V., s-Hertogenbosch (NL)

(72) Inventors: Patrick Grant, Tilburg (NL); Hans Van Sambeek, Drunen (NL)

(73) Assignee: Caterpillar Work Tools B.V., s-Hertogenbosch (NL)

( * ) Notice: Subject to any disclaimer, the term of this patent is extended or adjusted under 35 U.S.C. 154(b) by 0 days.

(21) Appl. No.: 15/113,895

(22) PCT Filed: Jan. 13, 2015

(86) PCT No.: PCT/EP2015/050510

§ 371 (c)(1),
(2) Date: Jul. 25, 2016

(87) PCT Pub. No.: WO2015/113812

PCT Pub. Date: Aug. 6, 2015

(65) Prior Publication Data

US 2016/0347585 A1 Dec. 1, 2016

(30) Foreign Application Priority Data

Feb. 3, 2014 (GB) ..... 1401789.1

(51) Int. Cl.
*B66C 3/04* (2006.01)
*B66C 3/16* (2006.01)

(52) U.S. Cl.
CPC . *B66C 3/16* (2013.01); *B66C 3/04* (2013.01)

(58) Field of Classification Search
CPC B66C 1/427; B66C 1/447; B66C 3/04; B66C 3/16; B25J 15/022; E02F 3/413; E02F 3/4135

(Continued)

(56) References Cited

U.S. PATENT DOCUMENTS 3,165,348 A 1/1965 Keskitalo
4,023,848 A 5/1977 Bennett (Continued)

FOREIGN PATENT DOCUMENTS

CN 2069847 1/1991
CN 101660324 3/2010

(Continued)

OTHER PUBLICATIONS

International Search Report dated Mar. 27, 2015, issued in PCT/EP2015/050510 (2 pages).

(Continued)

*Primary Examiner* — Dean Kramer

(57) ABSTRACT

A gripping device for attachment to a machine is disclosed. The gripping device may have a mounting structure and a tool housing attached to the mounting structure. The tool housing may have at least one tool attachment portion. The gripping device may have a first tool portion pivotally supported on the at least one tool attachment portion at a first pivot point, and an actuation member disposed between the mounting structure and the first tool portion. Further, the gripping device may have a second tool portion pivotally supported on the first tool portion. The gripping device may also have a push rod disposed between the second tool portion and the at least one tool attachment portion. The push rod may be selectively locked at the first pivot point or second pivot point on the at least one tool attachment portion.

20 Claims, 6 Drawing Sheets

(58) Field of Classification Search
USPC ..... 294/198; 414/739
See application file for complete search history.

(56) References Cited

U.S. PATENT DOCUMENTS

| | | | | |
|---|---|---|---|---|
| 4,084,306 | A | 4/1978 | Barker | |
| 4,452,479 | A | 6/1984 | Terai et al. | |
| 4,502,723 | A | 3/1985 | Kuromoto | |
| 5,863,086 | A * | 1/1999 | Christenson | B65F 3/04 294/106 |
| 6,398,282 | B1 | 6/2002 | Mononen | |
| 8,191,950 | B2 | 6/2012 | van Amelsfoort | |
| 8,210,587 | B2 | 7/2012 | Mizelmoe | |
| 8,474,893 | B2 * | 7/2013 | Kawanami | B25J 15/0213 294/106 |

FOREIGN PATENT DOCUMENTS

| | | | |
|---|---|---|---|
| CN | 102452608 | | 5/2012 |
| DE | 9217717 | * | 4/1993 |
| EP | 0224002 | A1 | 6/1987 |
| EP | 1688546 | A2 | 8/2006 |
| JP | 08-309685 | A | 11/1996 |
| WO | WO 96/08438 | A1 | 3/1996 |
| WO | WO 2008/063055 | A2 | 5/2008 |

OTHER PUBLICATIONS

GB Search Report dated Jul. 15, 2014, issued in GB1401789.1 (1 page).

* cited by examiner

GRIPPING DEVICE FOR MACHINE

CLAIM FOR PRIORITY

This application is a U.S. National Phase entry under 35 U.S.C. §371 from PCT International Application No. PCT/EP2015/050510, filed Jan. 13, 2015, which claims benefit of priority of GB Patent Application No. 1401789.1, filed Feb. 3, 2014, all of which are incorporated herein by reference.

TECHNICAL FIELD

The present disclosure relates to a gripping device for a machine, and particularly to an adjustable gripping device for the machine.

BACKGROUND

Implements of machines having one or more tool portions, such as grapples, crushers, pulverizers and shears are well known and commonly carried on a stick member of a machine. Such implements are used to engage materials of varying densities.

Generally, these implements are made up of single piece arms that are bent or curved to form a coverage width to enclose the desired object. However, based on the density of the materials being handled, the implement may handle more or less volume of the material. The total weight, i.e., the weight of the tool portions and the capacity of the tool portions which the implement can handle is determined by stability or hydraulic limitation of the machine and the stick member of the machine. Depending on the material density, these single piece arms can be changed every time accordingly. For example, when a heavy density material is to be engaged, then an implement having smaller coverage width may be used, whereas, when the material has a light density, then the implement having larger coverage width may be used to be able to handle more material volume. Changing the implements every time based on the material density is not desired as these implements are heavy and transportation costs associated with such heavy implements are high.

SUMMARY

In one aspect, a gripping device for attachment to a machine is provided. The gripping device includes a mounting structure and a tool housing attached to the mounting structure. The tool housing has a number of tool attachment portions. A first tool portion is pivotally supported on each of the tool attachment portions at a first pivot point. An actuation member is disposed between the mounting structure and the first tool portion to pivot the first tool portion about the first pivot point. A second tool portion is pivotally supported on the first tool. A push rod is disposed between the second tool portion and the tool attachment portion and is selectively locked at one of the first pivot point and a second pivot point on the tool attachment portion to selectively restrict a pivotal movement of the second tool portion with respect to the first tool portion.

In another aspect, a machine is provided. The machine includes an implement system and a gripping device attached to the implement system. The gripping device includes a mounting structure and a tool housing attached to the mounting structure. The tool housing has a number of tool attachment portions. A first tool portion is pivotally supported on each of the tool attachment portions at a first pivot point. An actuation member is disposed between the mounting structure and the first tool portion to pivot the first tool portion about the first pivot point. A second tool portion is pivotally supported on the first tool. A push rod is disposed between the second tool portion and the tool attachment portion and is selectively locked at one of the first pivot point and a second pivot point on the tool attachment portion to selectively restrict a pivotal movement of the second tool portion with respect to the first tool portion.

In a yet another aspect, a method for adjusting a radius of coverage width of a gripping device is provided. The method includes providing a mounting structure. Further, the method includes providing a tool housing attached to the mounting structure, the tool housing having two of more tool attachment portions. The method provides at least one first tool portion pivotally supported on each of the tool attachment portions at a first pivot point. The method provides an actuation member disposed between the mounting structure and the first tool portion, the actuation member is configured to pivot the first tool portion about the first pivot point. The method provides a push rod disposed between the second tool portion and the tool attachment portion. Furthermore, the method selectively locks the push rod at one of the first pivot point and a second pivot point on the tool attachment portion to selectively restrict a pivotal movement of the second tool portion with respect to the first tool portion.

DETAILED DESCRIPTION

Figure 1:
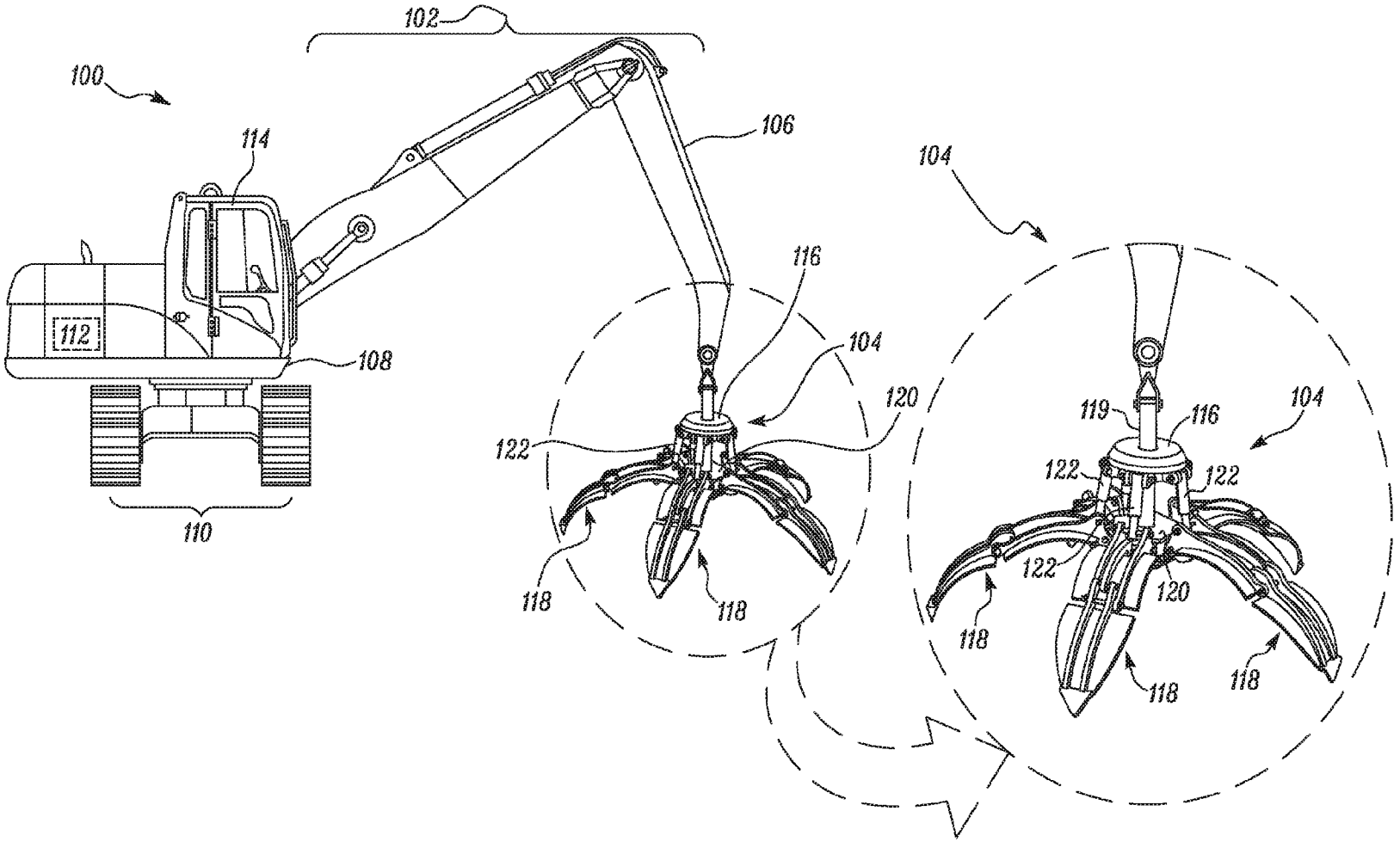
FIG. 1 illustrates an exemplary machine according to an embodiment of the present disclosure.

The present disclosure relates to a gripping device for attachment to a machine. FIG. 1 illustrates an exemplary machine 100, such as a hydraulic excavator. In other embodiments, the machine 100 may be a backhoe loader, a digger, a knuckle boom loader, a harvester or a forest machine. The machine 100 may include an implement system 102 configured to move or position an implement 104. The implement 104 may be attached to a stick member 106 of the implement system 102. As shown in FIG. 1, the machine 100 may further include a frame 108, a drive system 110 for propelling the machine 100, a power source 112 that provides power to the implement 104 and the drive system 110, and an operator station 114 to control the implement 104 and the drive systems 110. The operator station 114 includes one or more operator input devices configured to receive and/or transmit various inputs indicative of an operator desired movement of the implement 104 and/or the machine 100.

In an aspect of the present disclosure, the implement 104 may be embodied as a gripping device such as a scrap grapple, or an orange peel type grapple, etc., hereinafter referred to as the gripping device 104. However, it may be understood by a person having ordinary skill in the art, that the machine 100 may include additional implements mounted on the machine 100 for various other purposes.

The gripping device 104 includes a mounting structure 116 configured to attach the gripping device 104 to the stick member 106 of the machine 100. Further, the gripping device 104 includes a number of tools 118 pivotally attached to a tool housing 120 of the gripping device 104. Examples of tool 118 may include tines, shells, etc. The gripping device 104 may be a multiple tools grapple, such as a four tine grapple or a five tine grapple.

The gripping device 104 may be operated by pivoting the tools 118 using respective actuation member 122. In an exemplary embodiment, the actuation member 122 may be a hydraulic cylinder. The actuation member 122 may also be pivotally attached to the mounting structure 116 to facilitate the pivotal movement of the tools 118 for operating the gripping device 104. In this case, the mounting structure 116 remains fixed with respect to the tools 118 and the stick member 106 of the machine 100.

Alternatively, the actuation member 122 may be a cylindrical rod connected to the mounting structure 116 and the tools 118. For example, the mounting structure 116 is moveable to slide up and down a cylindrical rod 119 connecting the gripping device 104 to the stick member 106. In this case, a hydraulic actuator (not shown) may be disposed between the stick member 106 and the mounting structure 116, such that the hydraulic actuator is operable to move the mounting structure 116 up and down the rod 119, thereby causing the actuation member 122 to pivot the tools 118.

Furthermore, in an exemplary embodiment, the tools 118 may be adjustable to adjust the coverage width of the gripping device 104, as described in the following description in detail.

Figure 3:
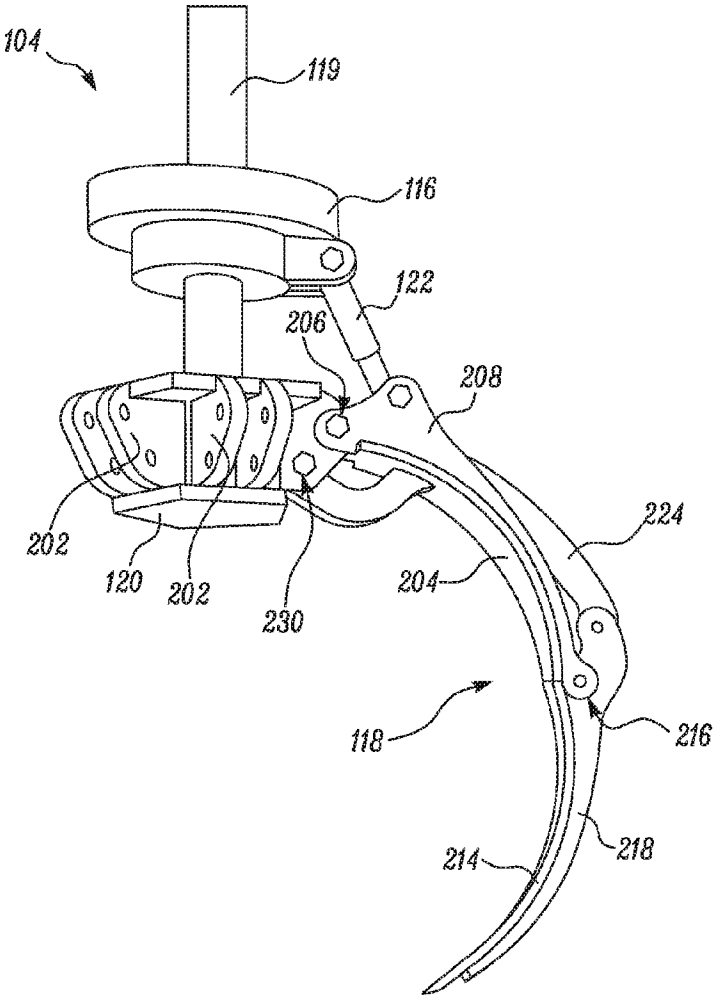
FIG. 3 illustrates an assembled view of the gripping device of FIG. 2, in accordance with an embodiment of the present disclosure.
Figure 2:
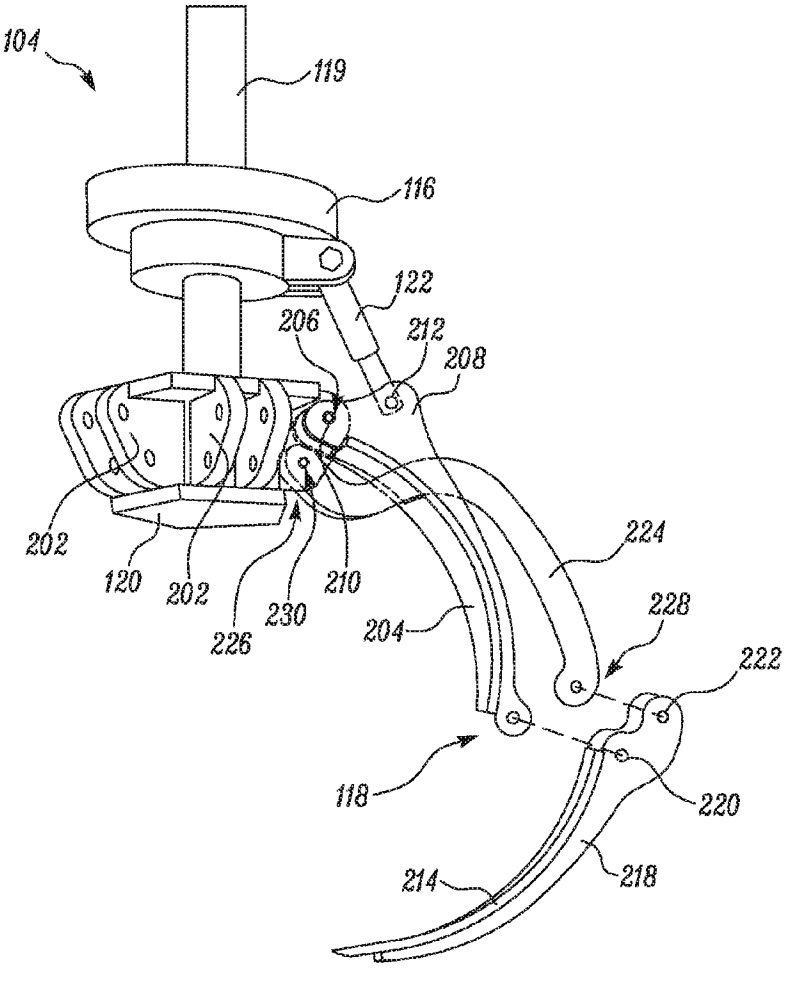
FIG. 2 illustrates an exploded view of a gripping device, according to an embodiment of the present disclosure.
Figure 5:
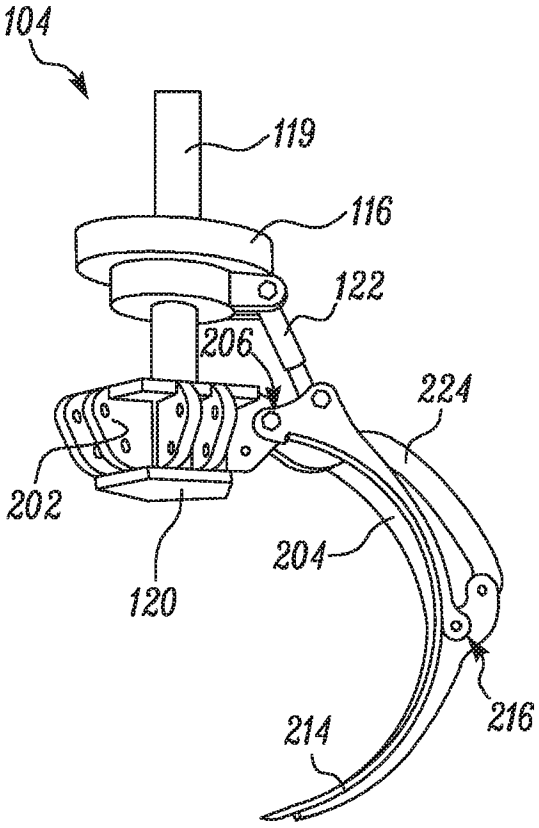
FIGS. 4 to 7 illustrate perspective views of different stages of opening the gripping device having a second tool portion locked with respect to a first tool portion, according to an embodiment of the present disclosure.
Figure 4:
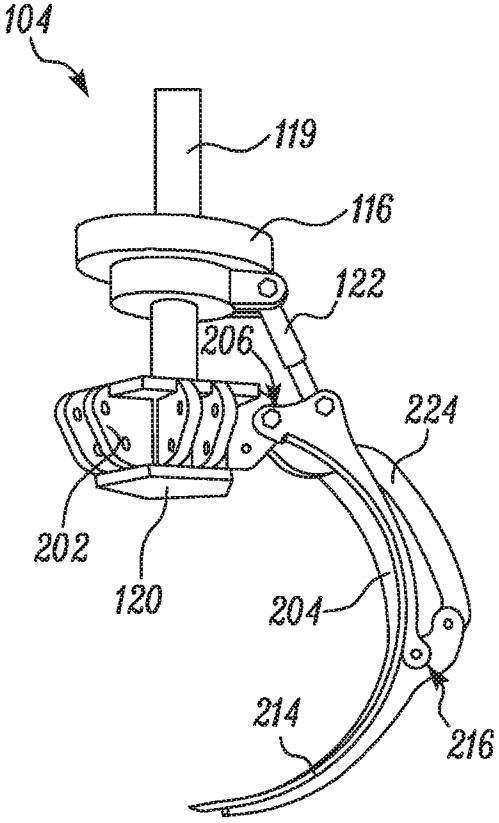

FIG. 2 illustrates an exploded view of the gripping device 104, according to an embodiment of the present disclosure. FIG. 3 illustrates an assembled view of the gripping device 104, according to the embodiment of the present disclosure. For the sake of simplicity in explanation, FIGS. 2 and 3 show the gripping device 104 with only one tool 118. As shown in FIGS. 2 and 3, the gripping device 104 includes the tool housing 120 attached to the mounting structure 116.

The tool housing 120 includes a number of tool attachment portions 202 configured to pivotally support the tool 118. In an exemplary embodiment, each tool 118 includes a first tool portion 204 pivotally supported on the tool attachment portion 202 at a first pivot point 206. The tool attachment portion 202 includes a first aperture defining the first pivot point 206 configured to pivotally support the first tool portion 204. The first tool portion 204 may be supported on the tool attachment portion 202 by a fastened joint, such as nut and bolt joint, hinged joint, etc., at the first pivot point 206 (as shown in FIG. 3).

As shown in FIGS. 2 and 3, the first tool portion 204 includes a first rib structure 208 configured to pivotally attach the first tool portion 204 to the tool attachment portion 202 and the actuation member 122. For example, the first rib structure 208 includes a first aperture 210 and a second aperture 212 disposed on one end of the first rib structure 208. The first aperture 210 is configured to pivotally attach the first tool portion 204 to the tool attachment portion 202 by a fastener. Further, the second aperture 212 is configured to attach the first tool portion 204 to the actuation member 122 by using a fastener. Further, the actuation member 122 may attach the first tool portion 204 to the mounting structure 116 of the gripping device 104.

In an exemplary embodiment of the present disclosure, the tool 118 further includes a second tool portion 214 configured to be pivotally supported on the first tool portion 204 at an articulation pivot point 216 (as shown in FIG. 3). It may be contemplated that the second tool portion 214 is configured to pivot with respect to the first tool portion 204 about the articulation pivot point 216. The second tool portion 214 includes a second rib structure 218 configured to pivotally attach the second tool portion 214 to the first tool portion 204. For example, the second rib structure 218 includes a third aperture 220 and a fourth aperture 222 disposed on one end of the second rib structure 218. The third aperture 220 defines the articulation pivot point 216 and is configured to attach the second tool portion 214 to a second end of the first rib structure 208 of the first tool portion 204.

In an embodiment of the present disclosure, the gripping device 104 further includes a push rod 224 configured to be disposed between the second tool portion 214 and the first tool portion 204. In an exemplary embodiment, the push rod 224 is a substantially S-shaped rod having a first end 226 and a second end 228. Each of the first end 226 and the second end 228 includes apertures, such that an aperture at the second end 228 is configured to be aligned with the fourth aperture 222 to attach the second tool portion 214 to the push rod 224 of the gripping device 104.

In an embodiment, the first end 226 of the push rod 224 is configured to be selectively locked at one of the first pivot point 206 and a second pivot point 230 on the tool attachment portion 202 of the gripping device 104. The second end 228 of the push rod 224 is configured to be attached to the fourth aperture 222 of the second tool portion 214 of the gripping device 104.

In an exemplary embodiment of the present disclosure, the push rod 224 is configured to selectively restrict a pivotal movement of the second tool portion 214 with respect to the first tool portion 204. For example, when the first end 226 of the push rod 224 is locked at the first pivot point 206, then the second tool portion 214 is locked with the first tool portion 204 thereby restricting the pivotal movement of the second tool portion 214 with respect to the first tool portion 204. On the other hand, when the first end 226 of the push rod 224 is locked at the second pivot point 230 on the tool attachment portion 202, then the second tool portion 214 is in an unlocked position thereby facilitating pivotal movement of the second tool portion 214 with respect to the first tool portion 204 about the articulation pivot point 216.

INDUSTRIAL APPLICABILITY

The industrial applicability of the gripping device 104 of the machine 100 described herein will be readily appreciated from the foregoing discussion.

The gripping device 104 includes the first tool portion 204 and the second tool portion 214 pivotally supported on the first tool portion 204. Furthermore, the push rod 224 facilitates adjusting of the gripping device 104 to adjust a radius of the coverage width of the gripping device 104. Therefore, single gripping device 104 may be used for engaging different volumes of materials based on their density. The gripping device 104 of the present disclosure provides a cost effective and safe implement that can be attached to various machines for engaging materials of varied densities.

Figure 7:
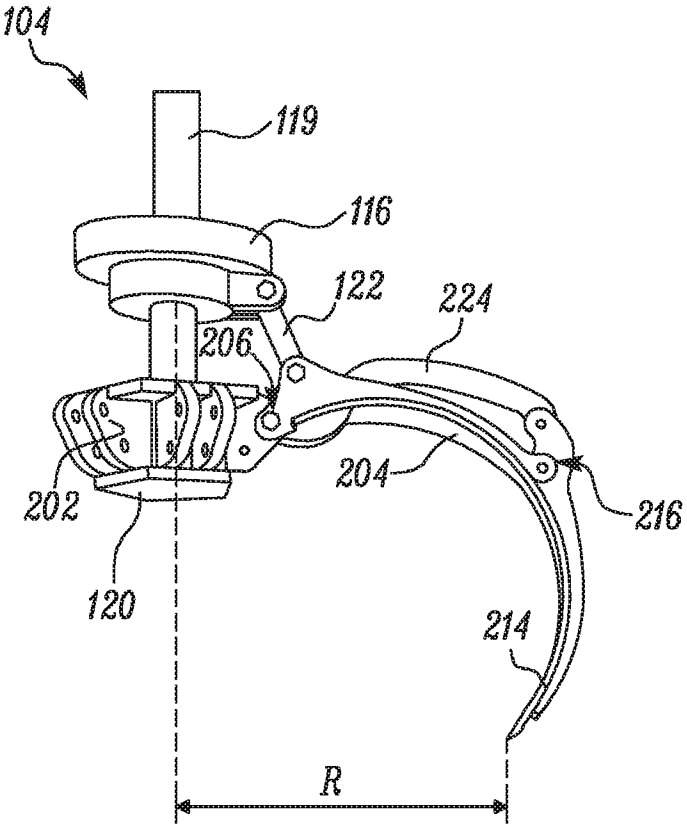
Figure 6:
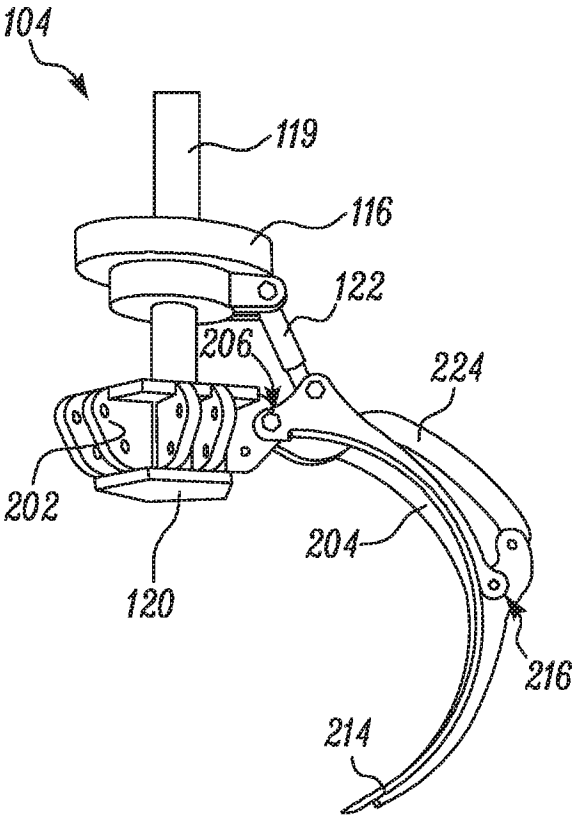
Figure 9:
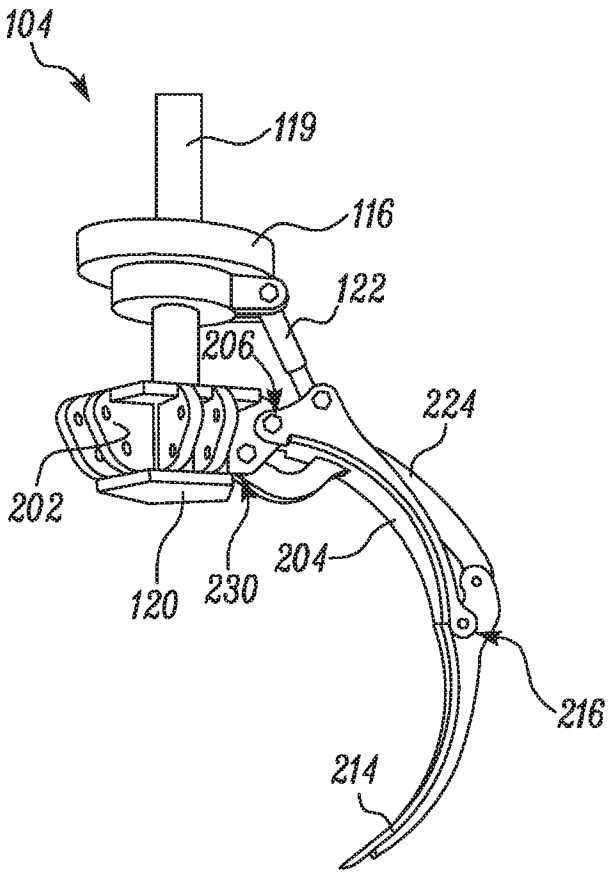
FIGS. 8 to 11 illustrate perspective views of different stages of opening the gripping device having the second tool portion unlocked with respect to the first tool portion, according to an embodiment of the present disclosure.
Figure 8:
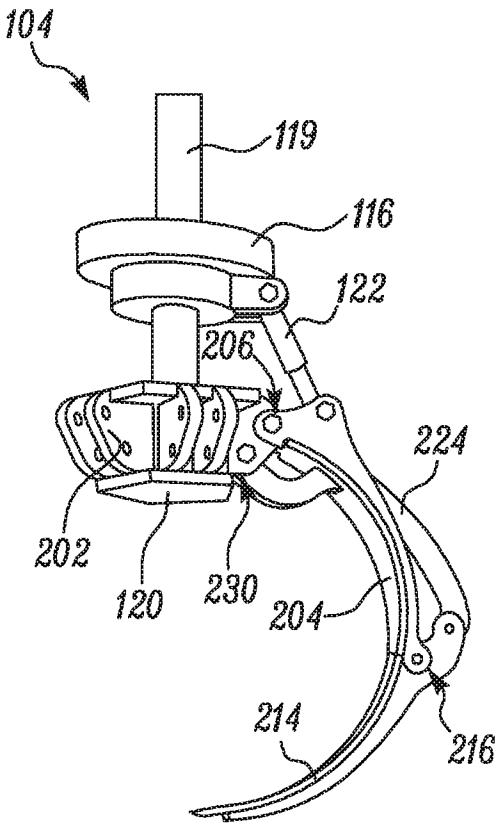

FIGS. 4 to 7 illustrate the various stages of opening the gripping device 104 having the second tool portion 214 locked with respect to the first tool portion 204. As shown in FIGS. 4 to 7, the push rod 224 is locked at the first pivot point 206 on the tool attachment portion 202, thereby restricting the pivotal movement of the second tool portion 214 with respect to the first tool portion 204. Therefore, in this case, in the completely open position of the gripping device 104 (as shown in FIG. 7) radius R of the coverage width is achieved.

Figure 11:
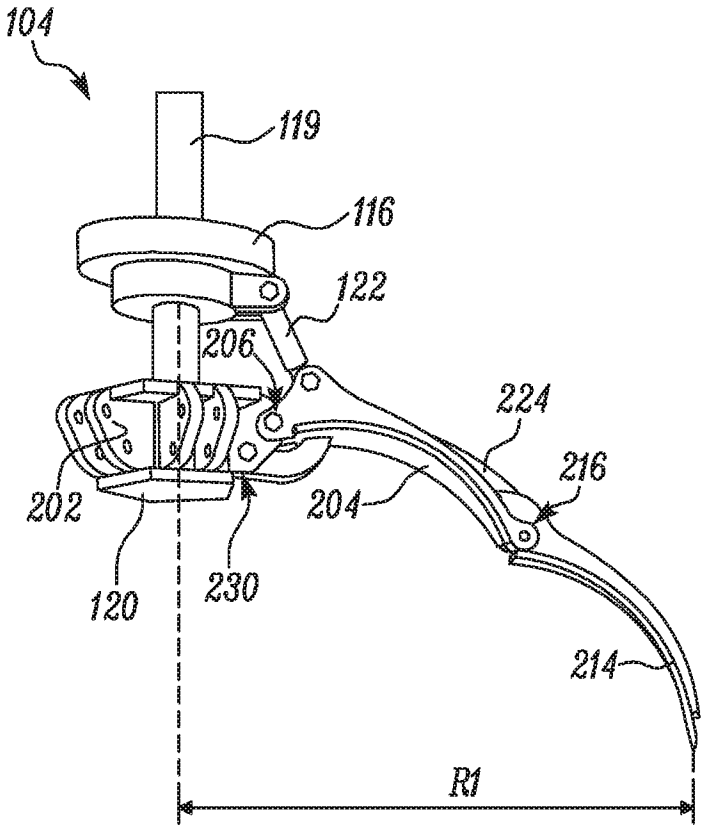
Figure 10:
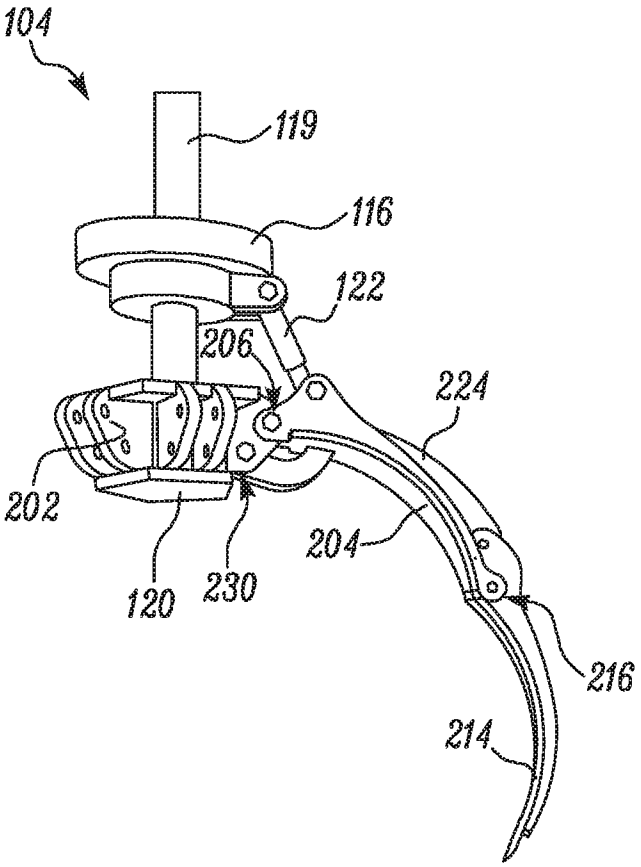

FIGS. 8 to 11 illustrate the various stages of opening the gripping device 104 having the second tool portion 214 unlocked with respect to the first tool portion 204. As shown in FIGS. 8 to 11, the push rod 224 is locked at the second pivot point 230 on the tool attachment portion 202, thereby facilitating the pivotal movement of the second tool portion 214 with respect to the first tool portion 204 about the articulation pivot point 216. Therefore, in this case, in the completely open position of the gripping device 104 (as shown in FIG. 11), radius R1 of the coverage width is achieved.

In an embodiment, the radius R1 of the coverage width of the gripping device 104 having the second tool portion 214 unlocked with respect to the first tool portion 204 is greater than the radius R of the coverage width of the gripping device 104 having the second tool portion 214 locked with respect to the first tool portion 204. It may be contemplated that the values of R and R1 may be dependent on the length of the first and the second tool portions 204, 214.

While aspects of the present disclosure have been particularly shown and described with reference to the embodiments above, it will be understood by those skilled in the art that various additional embodiments may be contemplated by the modification of the disclosed systems and methods without departing from the spirit and scope of what is disclosed. Such embodiments should be understood to fall within the scope of the present disclosure as determined based upon the claims and any equivalents thereof.

What is claimed is:

1. A gripping device for attachment to a machine, the gripping device comprising:
- a mounting structure;
- a tool housing attached to the mounting structure, the tool housing having at least one tool attachment portion;
- a first tool portion pivotally supported on the at least one tool attachment portion at a first pivot point;
- an actuation member disposed between the mounting structure and the first tool portion and configured to pivot the first tool portion about the first pivot point;
- a second tool portion pivotally supported on the first tool portion; and
- a push rod disposed between the second tool portion and the at least one tool attachment portion, the push rod configured to be selectively locked at one of the first pivot point and a second pivot point on the at least one tool attachment portion to selectively restrict a pivotal movement of the second tool portion with respect to the first tool portion.

2. The gripping device of claim 1, wherein the gripping device is one of a scrap grapple and an orange peel type grapple.

3. The gripping device of claim 1, wherein the first tool portion and the second tool portion are tines.

4. The gripping device of claim 1, wherein the actuation member is a hydraulic actuator.

5. The gripping device of claim 1, wherein the first tool portion includes a first rib structure configured to pivotally attach the first tool portion to the at least one tool attachment portion.

6. The gripping device of claim 1, wherein the second tool portion includes a second rib structure configured to pivotally attach the second tool portion to the first tool portion at an articulation pivot point.

7. The gripping device of claim 1, wherein the push rod has a generally S shape.

8. The gripping device of claim 1, wherein the push rod extends from a first end to a second end, the first end being disposed on a first side of the first tool portion, and the second end being disposed on a second side of the first tool portion opposite the first side.

9. The gripping device of claim 1, wherein the at least one tool attachment portion is a first tool attachment portion, and the gripping device further includes:
- a second tool attachment portion;
- a third tool portion pivotally supported on the second tool attachment portion at a third pivot point; and
- a fourth tool portion pivotally supported on the third tool portion.

10. A machine comprising:
- an implement system; and
- a gripping device attached to the implement system, the gripping device including:
  - a mounting structure;
  - a tool housing attached to the mounting structure, the tool housing having at least one tool attachment portion;
  - a first tool portion pivotally supported on the at least one tool attachment portion at a first pivot point;
  - an actuation member disposed between the mounting structure and the first tool portion and configured to pivot the first tool portion about the first pivot point;
  - a second tool portion pivotally supported on the first tool portion; and
  - a push rod disposed between the second tool portion and the at least one tool attachment portion, the push rod configured to be selectively locked at one of the first pivot point and a second pivot point on the at least one tool attachment portion to selectively restrict a pivotal movement of the second tool portion with respect to the first tool portion.

11. The machine of claim 10, wherein the gripping device is one of a scrap grapple and an orange peel type grapple.

12. The machine of claim 10, wherein the first tool portion and the second tool portion are tines.

13. The machine of claim 10, wherein the actuation member is a hydraulic actuator.

14. The machine of claim 13, wherein the push rod is generally S-Shaped.

15. The machine of claim 10, wherein the first tool portion includes a first rib structure configured to pivotally attach the first tool portion to the at least one tool attachment portion.

16. The machine of claim 10, wherein the second tool portion includes a second rib structure configured to pivotally attach the second tool portion to the first tool portion at an articulation pivot point.

17. A method for adjusting a radius of coverage width of a gripping device, the method comprising:
- providing a mounting structure;
- attaching a tool housing to the mounting structure, the tool housing including at least one tool attachment portion;
- supporting a first tool portion pivotally on the at least one tool attachment portion at a first pivot point;
- pivoting the first tool portion about the first pivot point using an actuation member disposed between the mounting structure and the first tool portion;

pivotally supporting a second tool portion on the first tool portion;

connecting a push rod between the second tool portion and the at least one tool attachment portion; and selectively locking the push rod at one of the first pivot point and a second pivot point on the tool attachment portion to selectively restrict a pivotal movement of the second tool portion with respect to the first tool portion.

18. The method of claim 17, wherein the gripping device is one of a scrap grapple and an orange peel type grapple.

19. The method of claim 17, wherein the first tool portion and the second tool portion are tines.

20. The method of claim 17, wherein the actuation member is a hydraulic actuator.

* * * * *